United States Patent [19]

DuBois

[11] Patent Number: 4,557,224

[45] Date of Patent: Dec. 10, 1985

[54] MECHANISM FOR PRODUCING AUDIBLE WARNING IN RESPONSE TO COOLANT SYSTEM FAILURE

[75] Inventor: Chester G. DuBois, Zion, Ill.

[73] Assignee: Outboard Marine Corporation, Waukegan, Ill.

[21] Appl. No.: 211,640

[22] Filed: Dec. 1, 1980

[51] Int. Cl.[4] ..... F01P 11/18

[52] U.S. Cl. ..... 123/41.15; 123/198 D; 116/70; 116/101

[58] Field of Search ..... 123/41.15, 198 D, 196 S, 123/41.01, 41.44, 41.55; 440/2, 84, 88, 900, 53; 236/42, 43, 94; 116/28 R, 56, 67 R, 58, 70, 101, 102, 103, 112, 142 FP, 268; 74/570, 573, 612, 613; 60/39, 83

[56] References Cited

U.S. PATENT DOCUMENTS

| | | | |
|---|---|---|---|
| 2,131,811 | 10/1938 | Kittredge | 123/41.15 |
| 2,988,069 | 6/1961 | Smith | 123/41.15 |
| 3,007,461 | 11/1961 | Armbrust | 123/41.15 |
| 3,518,887 | 7/1970 | Armbrust | 123/41.15 X |
| 3,782,358 | 1/1974 | Lenz | 123/41.15 X |
| 4,019,489 | 4/1977 | Cart Mill | 123/41.15 X |
| 4,078,531 | 3/1978 | Hewitt | 123/41.15 X |
| 4,144,862 | 3/1979 | Estkowski | 123/198 D X |
| 4,148,271 | 4/1979 | Majernik | 116/67 R |
| 4,152,881 | 5/1979 | Hoff | 192/30 W |

*Primary Examiner*—William A. Cuchlinski, Jr.
*Attorney, Agent, or Firm*—Michael, Best & Friedrich

[57] ABSTRACT

Disclosed herein is an engine including a flywheel starting gear and a cooling system, a member mounted on the engine for displacement between a first position engaged with the flywheel gear so as to produce an audible noise in response to engine rotation and a second position clear of the flywheel gear, a spring biasing the member toward one of the first and second positions, and a temperature or pressure responsive plunger for displacing the member to the other of the first and second positions against the action of the spring in response to malfunctioning of the cooling system.

21 Claims, 5 Drawing Figures

MECHANISM FOR PRODUCING AUDIBLE WARNING IN RESPONSE TO COOLANT SYSTEM FAILURE

BACKGROUND OF THE INVENTION

The invention relates generally to internal combustion engines including cooling systems. More specifically, the invention relates to marine propulsion devices including internal combustion engines having cooling systems.

Attention is directed to the Armbrust U.S. Pat. No. 3,518,887 issued July 7, 1970 which discloses an arrangement for providing a visual or light signal in the event of water pump failure.

Attention is also directed to the Lenz U.S. Pat. No. 3,782,358 which discloses a device for slowing down or stopping spark plug firing whenever the engine reaches a predetermined temperature to prevent damage to the engine.

SUMMARY OF THE INVENTION

The invention provides an engine including a rotary part, a cooling system, and means selectively engageable with the rotary part in response to malfunctioning of the cooling system for producing an audible noise.

In one embodiment of the invention, the means selectively engageable with the rotary part is temperature responsive.

In one embodiment of the invention, the means selectively engageable with the rotary part is pressure responsive.

In one embodiment of the invention, the means selectively engageable with the rotary part includes a member, means mounting the member on the engine for displacement between a first position engaged with with the rotary part so as to produce an audible noise in response to engine rotation and a second position clear of the rotary part, means biasing the member toward one of the first and second positions, and means for displacing the member to the other of the first and second positions against the action of the member biasing means in response to malfunctioning of the cooling system.

In one embodiment of the invention, the member is pivotally mounted.

In one embodiment of the invention, the rotary part is a flywheel and preferably a flywheel gear.

In one embodiment of the invention, the member comprises a roller mounted for rotation and having a cylindrical surface engageable, when in the first position, with the rotary part so as to cause roller rotation in response to rotation of the rotary part, the roller also including means for producing an audible sound in response to roller rotation.

In one embodiment of the invention, the member biasing means biases the member into the second position, the member displacing means displaces the member to the first position, is temperature responsive, and comprises a temperature sensor mounted on the engine and including a plunger movable between a retracted position when the engine temperature is below a predetermined level and an extended position in engagement with the member so as to displace the member to the first position when the engine temperature is above the predetermined level.

In one embodiment of the invention, the member biasing means biases the member to the first position and the member displacing means displaces the member to the second position, is responsive to the absence of pressure in the coolant system, and comprises a chamber having a movable wall, a plunger extending from the movable wall for engagement with the member, means biasing the plunger away from the member, and a duct communicating between the chamber and the coolant system so as to expose the movable wall to the pressure in the coolant system.

In one embodiment of the invention, the movable wall comprises a diaphragm, and the engine includes a coolant pump having a pressure outlet, and the duct communicates with the pressure outlet.

In one embodiment of the invention, the engine includes a transmission shiftable relative to a neutral position and also includes a linkage operably connected to the transmission and engageable with the member to displace the member against the action of the member biasing means to the second position when the transmission is in neutral.

Other features and advantages of the embodiments of the invention will become known by reference to the following general description, claims and appended drawings.

IN THE DRAWINGS

Figure 1:
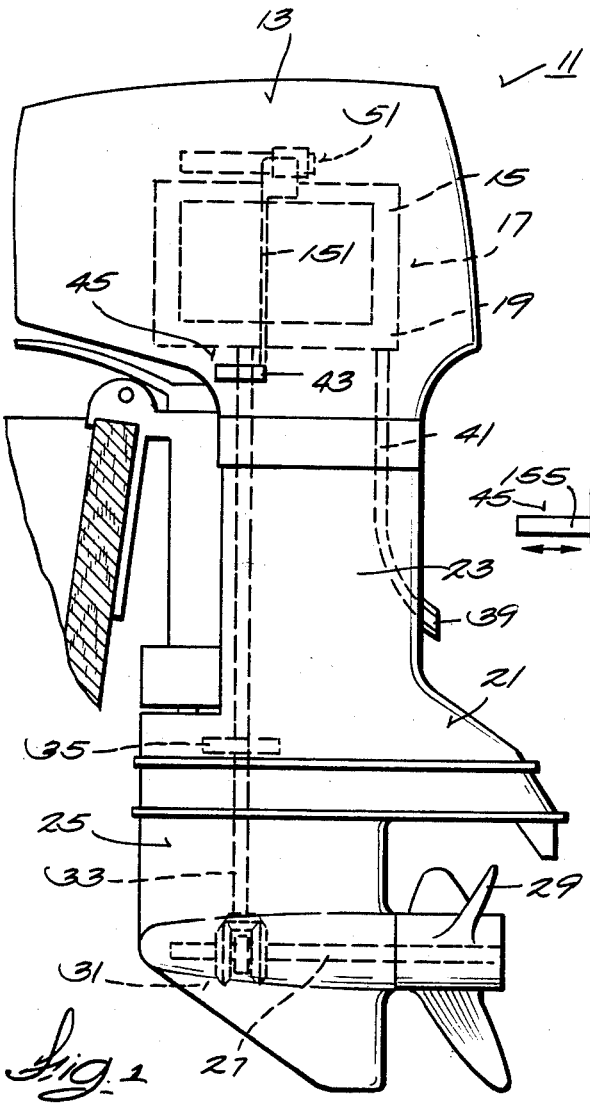
FIG. 1 is a partially schematic perspective view of an outboard motor incorporating various of the features of the invention.

Before explaining three embodiments of the invention in detail, it is to be understood that the invention is not limited to its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 2:
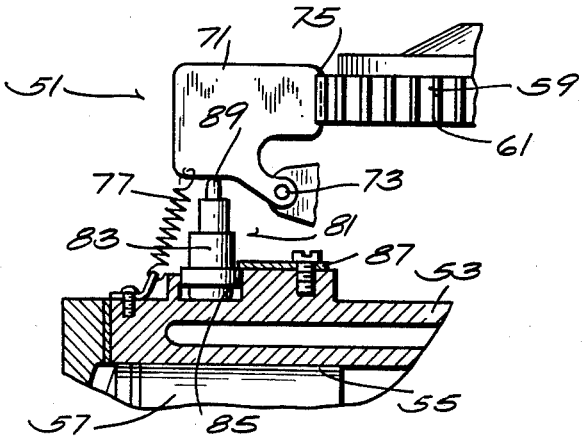
FIG. 2 is an enlarged, partially schematic and partially sectioned view of a mechanism which is incorporated in the outboard motor shown in FIG. 1 and which produces an audible signal in response to cooling system failure.

Shown schematically in FIG. 1 is a marine propulsion device in the form of an outboard motor 11 including a power head 13 comprising an internal combustion engine 15 which includes a cooling system 17 including a water jacket 19 (see FIG. 2). The outboard motor 11 also includes a lower unit 21 which includes a drive shaft housing 23 rigidly supporting the power head 13, together with a gear case section 25 which is connected to the lower end of the drive shaft housing 23 and which supports a propeller shaft 27 carrying a propeller 29. The propeller shaft 27 is operably connected through a reversing transmission 31 with a drive shaft 33 which extends through the drive shaft housing 23 to the internal combustion engine 15.

Also located in the lower unit 21 and driven by the drive shaft 33 is a water pump 35 which can be of any suitable construction, and which, when the propeller 29 is immersed in water, communicates through a suitable duct (not shown) with the water, and which includes a discharge outlet 39 connected by a conduit 41 to the water jacket 19. Any suitable means (not shown) can be employed to control recirculation and/or overboard discharge of the coolant water.

The transmission 31 is controlled by a shift lever 43 which is movable between a neutral position and one or more drive positions, which is connected to the transmission 31, and which forms a part of a suitable control linkage 45.

Also included in the outboard motor 11 shown in FIGS. 1 and 2 is means 51 for providing an audible signal in response to malfunctioning of the cooling system 17, as for instance, by breakage or incapacity of the pump 35, or by reason of blockage of one or more of the ducts in the cooling system 17.

More particularly, as shown in FIG. 2, the engine includes a block 53 which, at least in part, defines the cooling jacket 17, as well as one or more cylinders 55, each including a piston 57. In addition, as shown in FIG. 2, the engine 15 includes a rotatable flywheel 59 having thereon a starter gear 61, which flywheel 59 rotates in response to engine operation and constitutes a rotatable engine part. Other rotatable engine parts could be employed in the invention.

The means 51 for producing an audible sound in response to cooling system malfunction further includes a member of flapper 71 mounted on the engine 15 for movement between a first position in engagement with the starter gear 61 so as to produce an audible noise in response to starter gear rotation and a second or quiet position spaced from the starter gear 61. While various constructions can be employed, in the illustrated construction, the member 71 is pivotally mounted about an axis 73 fixed with respect to the engine 15 and extending transversely of the flywheel axis, is fabricated of relatively thin metal or plastic so as to produce noise in response to engagement with the flywheel gear 61, and has a flat edge 75 engageable with the flywheel gear 61.

The means 51 for producing an audible sound in response to cooling system malfunction also includes means for biasing the member 71 to the second position clear of the flywheel gear 61. While various arrangements can be employed, in the illustrated construction, such means comprises a biasing spring 77, which at one end, is connected to an anchor on the engine block 53 and which, at the other end, is connected to the member 71.

The means 51 for producing an audible sound in response to cooling system malfunction also includes means 81 for displacing the member to the first or noise producing position in engagement with the flywheel gear 61 in response to cooling system malfunction. While various arrangements can be employed, in the illustrated construction, such means 81 comprises a heat sensor 83 which is suitably attached to the engine block 53, preferably in a recess 85 in the block 53, by a suitable clamp 87 or other means, and which includes a plunger 89 movable between a relatively retracted position and an advanced or extended position in engagement with the member 71 and in which the member 71 is displaced to the first position in engagement with the flywheel gear 61 so as to produce an audible noise in response to flywheel gear rotation.

The plunger 89 is movable to the extended position in response to the presence in the engine block 53 of a temperature above a predetermined level. Thus, in the event of a cooling system malfunction and concurrent elevation of engine temperature above the predetermined level, the plunger 89 will cause engagement of the member 71 with the flywheel gear 61 as to provide an audible sound in response to flywheel rotation. When the engine temperature falls below the predetermined level, the plunger 89 retracts and the biasing means or spring 77 locates the member 71 in the second position clear of engagement with the flywheel.

Figure 3:
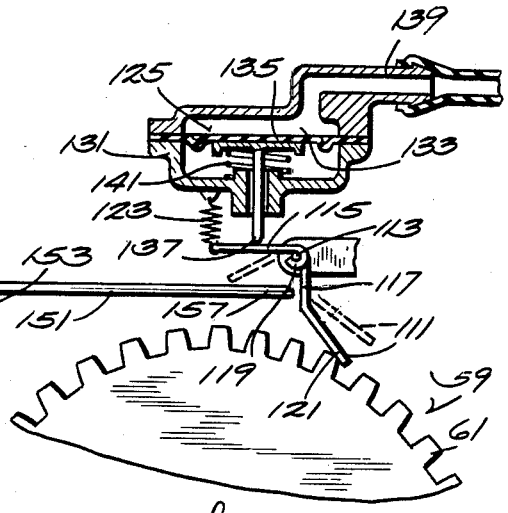
FIG. 3 is a partially schematic view of another embodiment of a mechanism for producing an audible signal in response to cooling system failure.

Shown in FIG. 3 is another arrangement for providing an audible sound in response to rotation of an engine part. In the construction shown in FIG. 3, the means 51 for producing an audible sound in response to cooling system malfunction includes a member or flapper 111 which is displaceable between a first position engaged with the engine flywheel gear 61 so as to produce an audible noise in response to flywheel gear rotation, and a second position clear of the flywheel gear 61. While various arrangements can be employed, in the illustrated construction, the member or flapper 111 is pivotable about an axis 113 fixed relative to the engine 15 and parallel to the flywheel axis and includes first and second arms 115 and 117, respectively extending from a pivotal mounting 119 at right angles to each other. Extending from the second arm 117, at a suitable angle, is a portion 121 which, when the member 111 is in the first or engaged position, extends at an angle so as to at least partially into the space between the teeth of the flywheel gear 61 and to consequently rapidly move in and out and cause the production of audible noise in response to engine operation.

The means 51 for producing an audible sound in response to cooling system malfunction further includes means biasing the member or flapper 111 to the first or engaged position. While various arrangements can be employed, in the illustrated construction, such means comprises a spring 123 which, at one end, is connected to the first arm 115, and, at the other end, is fixed relative to the engine 15 so as to bias the flapper or member 111 into the engaged position.

The means 51 for producing an audible sound in response to cooling system malfunction further includes means 125 for displacing the member or flapper 111 to the second or disengaged position against the action of the spring 123. While various arrangements can be employed, in the illustrated construction, such means 125 comprises a housing 131 which is fixed relative to the engine 15 and which defines a chamber 133 including a movable wall 135, a plunger 137 extending from the movable wall toward the first arm 115 of the member or flapper 111, and a duct or conduit 139 which communicates with the chamber 133 and with the cooling system 17 so as to expose the chamber 133 to the pressure in the cooling system 17. In addition, means in the form of a spring 141 acting between the housing 131 and the movable wall 135 is provided for biasing the plunger 137 away from the first arm 115. While various movable wall constructions can be employed, in the illustrated construction, the movable wall 135 comprises a diaphragm supported at the periphery thereof by the housing 131.

Accordingly, when the engine 15 is operating normally, the pressure in the coolant produced by the water pump 35 acts on the diaphragm 135 and overcomes the action of the spring 141 to cause such extension of the plunger 137 as is effective to displace the member or flapper 111 from the position engaged with the flywheel gear 61 to the spaced position. Thus, with proper cooling function, the engine 15 operates without the production of noise. However, should the pressure drop below some preselected limit due to cooling system malfunction, the absence of sufficient pressure in the chamber 133 will permit the spring 141 to retract the plunger 137, thereby permitting displacement of the member or flapper 111 into the flywheel engaging position by the spring 123 and thereby producing an audible sound warning the operator of cooling system malfunction.

Because the member or flapper 111 is biased into engagement with the flywheel gear 61 when the engine 15 is not operating and in order to displace the member or flapper 111 from the engaged position to facilitate starting, means are provided for displacing the member or flapper 111 to the second or clear or quiet position when the transmission 31 is in neutral condition. While various arrangements can be employed, in the illustrated construction, such means comprises a linkage or rod 151 which is suitably supported for movement by the outboard motor 11 and which is operably connected to the transmission control linkage 45 and to the member or flapper 111. More specifically, the rod 151 includes one end which is bent at 153 so as to be engaged by a part 155 of the transmission control linkage 45, and a second end 157 which is normally engaged with or in closely adjacent relation to the second arm 117 when the transmission control linkage 45 is in a drive position. Accordingly, when the transmission 31 is in drive, the member or flapper 111 is biased by the spring 123 into the position of engagement with the flywheel gear 61 subject to the action of the pressure plunger 137. However, when the transmission 31 is shifted to neutral, such movement serves to displace the rod 151 to the right as shown in FIG. 3, thereby to displace the member or flapper 111 against the action of the spring 123 to the clear or second position (shown in dotted outline) avoiding engagement with the flywheel gear 61 and facilitating engine starting without production of audible noise by the member or flapper 111. However, whenever the transmission 31 is shifted to a drive condition, (shown in full line) the spring 123 serves to displace the member or flapper 111 to the engaged position and to displace the rod 151 to the full line position, all subject to the action the pressure plunger 137.

Figure 4:
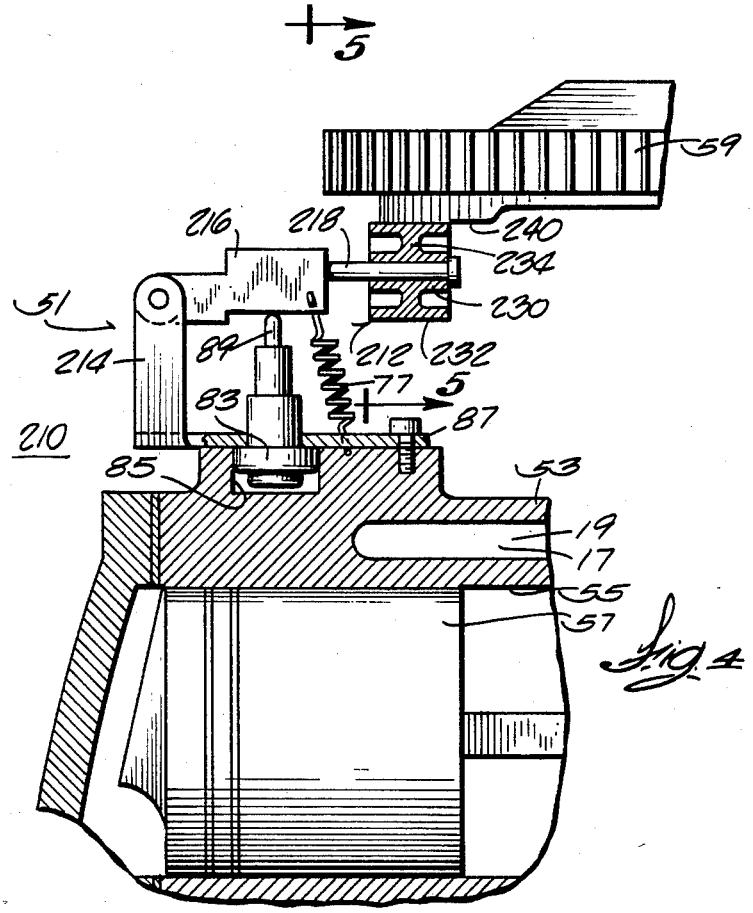
FIG. 4 is a partially schematic view of another embodiment of a mechanism for producing an audible signal in response to cooling system failure.
Figure 5:
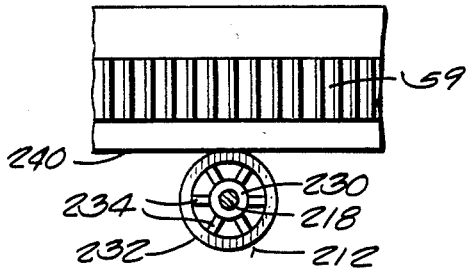
FIG. 5 is a fragmentary end view taken along line 5—5 of FIG. 4.

Shown in FIGS. 4 and 5 is still another arrangement for producing an audible sound in response to rotation of an engine part. In the construction shown in FIGS. 4 and 5, like numbers are used for similar components to those already described. Also in the construction shown in FIGS. 4 and 5, the means 51 for producing an audible sound in response to cooling system malfunction comprises, in addition to a heat sensor 83, a roller 212 which is movable into and out of engagement with the flywheel 59 and which, when in engagement with the flywheel 59 in response to an over-heated condition, rotates to produce a siren or whistle like sound.

More particularly, as in the FIG. 1 embodiment, the heat sensor 83, includes a plunger 89 which extends upwardly from the sensor 83 in response to the development of excessive heat occurring in response to malfunction of the cooling system 17. In addition, the clamp member 87 includes an upwardly extending bracket-like link or leg 214 to which is pivotally mounted an arm 216 having a stud 218 projecting therefrom. Rotatably carried on the stud 218 is the roller 212 which includes an inner hub 230, an outer cylindrical surface 232, and a series of radial spokes 234 between the inner hub 230 and the outer cylindrical surface 232, which spokes 234 generate a siren or whistle like noise in response to roller rotation.

The roller 212 is pivotally movable about the connection between the leg 214 and the arm 216 between a position disengaged from an annular raised surface 240 on the flywheel 59 and the position engaged therewith so as to effect roller rotation in response to flywheel rotation.

As in the construction shown in FIG. 2, the arm 216 is biased to the position disengaging the roller 212 from the flywheel 59 by a spring 77 and is displaced into engagement with the flywheel 59 against the action of the spring 77 in response to upward projection of the plunger 89 consequent to malfunction of the cooling system 17.

Various of the features of the invention are set forth in the following claims:

I claim:

1. An engine including a flywheel, a cooling system, and means including a member selectively engageable with said flywheel in response to malfunctioning of said cooling system for producing an audible noise.

2. An engine in accordance with claim 1 wherein said means for producing an audible noise also includes temperature responsive means and wherein said member is slectively engageable with said flywheel in response to actuation of said temperature responsive means.

3. An engine in accordance with claim 1 wherein said means for producing an audible noise also includes pressure responsive means and wherein said member is selectively engageable with said flywheel in response to actuation of said pressure responsive means.

4. An engine including a flywheel, a cooling system, and means selectively engageable with said flywheel in response to malfunctioning of said cooling system for producing an audible noise, said means selectively engageable with said flywheel including a member, means mounting said member on said engine for displacement between a first position engaged with said flywheel so as to produce an audible noise in response to engine rotation and a second position clear of said flywheel, means biasing said member toward one of said first and second positions, and means for displacing said member to the other of said first and second positions against the action of said member biasing means in response to malfunctioning of said cooling system.

5. An engine in accordance with claim 4 wherein said means selectively engageable with said flywheel is temperature responsive.

6. An engine in accordance with claim 4 wherein said means selectively engageable with said flywheel is pressure responsive.

7. An engine in accordance with claim 4 wherein said member is pivotally mounted.

8. An engine in accordance with claim 4 wherein said flywheel includes a part engaged by said member and wherein said part is a flywheel gear.

9. An engine in accordance with claim 4 wherein said member biasing means biases said member to said second position and said member displacing means displaces said member to said first position.

10. An engine in accordance with claim 9 wherein in said member displacing means is responsive to engine temperature.

11. An engine in accordance with claim 9 wherein said member displacing means comprises a temperature sensor mounted on said engine and including a plunger movable between a retracted position when the engine temperature is below a predetermined level and an extended position in engagement with said member so as to displace said member to said first position when the engine temperature is above the predetermined level.

12. An engine in accordance with claim 4 wherein said member biasing means biases said member to said first position and said member displacing means displaces said member to said second position.

13. An engine in accordance with claim 12 wherein said member displacing means is pressure responsive.

14. An engine in accordance with claim 12 wherein said member displacing means comprises a chamber having a movable wall, a plunger extending from said movable wall for engagement with said member, means biasing said plunger away from said member, and a duct communicating between said chamber on said coolant system so as to expose said movable wall to the pressure in said coolant system.

15. An engine in accordance with claim 14 wherein said movable wall comprises a diaphragm, and wherein said engine includes a coolant pump having a pressure outlet, and wherein said duct communicates with said pressure outlet.

16. An engine including a flywheel, a cooling system, means selectively engageable with said flywheel in response to malfunctioning of said cooling system for producing an audible noise, said means selectively engageable with said flywheel including a member, means mounting said member on said engine for displacement between a first position engaged with said flywheel so as to produce an audible noise in response to engine rotation and a second position clear of said flywheel, means biasing said member toward said first position, and means for displacing said member to said second position against the action of said member biasing means in response to malfunctioning of said cooling system, a transmission shiftable relative to a neutral position, and a linkage operably connected to said transmission and engageable with said member to displace said member against the action of said member biasing means to said second position when said transmission is in neutral.

17. An engine including a flywheel, a cooling system, and means selectively engageable with said flywheel in response to malfunctioning of said cooling system for producing an audible noise, said means selectively engageable with said flywheel including a roller, having a cylindrical surface and including means for producing an audible sound in response to roller rotation, means mounting said roller on said engine for rotation relative thereto and displacement between a first position with said surface engaged with said flywheel so as to cause roller rotation and production of a audible noise in response to flywheel rotation and a second position clear of said flywheel, means biasing said member toward one of said first and second position, and means for displacing said member to the other of said first and second positions against the action of said member biasing means in response to malfunctioning of said cooling system.

18. An engine including a rotary part, a cooling system, and means selectively engageable with said rotary part in response to malfunctioning of said cooling system for producing an audible noise and including a member, and means mounting said member on said engine for displacement between a first position engaged with said rotary part so as to produce an audible noise in response to engine rotation and a second position clear of said rotary part.

19. An engine including a rotary part, a cooling system, and means selectively engageable with said rotary part in response to malfunctioning of said cooling system for producing an audible noise and including a member, and means mounting said member on said engine for displacement between a first position engaged with said rotary part so as to produce an audible noise in response to engine rotation and a second position clear of said rotary part, means biasing said member toward one of said first and second positions, and means for displacing said member to the other of said first and second positions against the action of said member biasing means in response to malfunctioning of said cooling system.

20. An engine including a flywheel, a cooling system, and means selectively engageable with said flywheel in response to malfunctioning of said cooling system for producing an audible noise, said means selectively engageable with said flywheel including a member, and means mounting said member on said engine for displacement between a first position engaged with said flywheel so as to produce and audible noise in response to engine rotation and a second position clear of said flywheel.

21. An engine including a rotary part, a cooling system, and temperature responsive means operable in response to malfunctioning of said cooling system for producing an audible noise, said temperature responsive means including a member selectively engageable with said rotary part in response to an increase in temperature in said cooling system above a predetermined level.

* * * * *